US008827450B2

(12) United States Patent
Tanaka et al.

(10) Patent No.: US 8,827,450 B2
(45) Date of Patent: Sep. 9, 2014

(54) EYEGLASS LENS PROCESSING SHAPE OBTAINING METHOD

(75) Inventors: Motoshi Tanaka, Aichi (JP); Toshiro Matsumoto, Aichi (JP)

(73) Assignee: Nidek Co., Ltd., Aichi (JP)

( * ) Notice: Subject to any disclaimer, the term of this patent is extended or adjusted under 35 U.S.C. 154(b) by 116 days.

(21) Appl. No.: 13/397,153

(22) Filed: Feb. 15, 2012

(65) Prior Publication Data

US 2012/0206693 A1 Aug. 16, 2012

(30) Foreign Application Priority Data

Feb. 16, 2011 (JP) ..... 2011-031460
Feb. 10, 2012 (JP) ..... 2012-027508

(51) Int. Cl.
*G02C 13/00* (2006.01)

(52) U.S. Cl.
USPC .... 351/178; 351/158; 351/159.75; 351/159.8

(58) Field of Classification Search
USPC ..... 351/178, 158, 159.75, 159.8
See application file for complete search history.

(56) References Cited

U.S. PATENT DOCUMENTS

| | | | | |
|---|---|---|---|---|
| 4,216,588 | A * | 8/1980 | Richards et al. | 33/574 |
| 4,724,617 | A * | 2/1988 | Logan et al. | 33/28 |
| 5,121,550 | A * | 6/1992 | Wood et al. | 33/551 |
| 2004/0008877 | A1 | 1/2004 | Leppard et al. | |
| 2004/0142642 | A1 | 7/2004 | Thepot et al. | |
| 2007/0212992 | A1 | 9/2007 | Perez et al. | |
| 2007/0226991 | A1 | 10/2007 | Matsuyama | |
| 2008/0297776 | A1 | 12/2008 | Mizuno et al. | |
| 2009/0142993 | A1 | 6/2009 | Obayashi | |

FOREIGN PATENT DOCUMENTS

| | | | |
|---|---|---|---|
| EP | 1 832 388 | A1 | 9/2007 |
| EP | 1 997 585 | A1 | 12/2008 |
| FR | 2 825 308 | A1 | 12/2002 |
| JP | 2006-510065 | A | 3/2006 |
| JP | 2007-275998 | A | 10/2007 |
| JP | 2009-131939 | A | 6/2009 |
| JP | 2010-262034 | A | 11/2010 |
| WO | 03/071222 | A2 | 8/2003 |
| WO | WO 2004/059367 | A2 | 7/2004 |

OTHER PUBLICATIONS

Nidek, Multifunction Edger, Me 1200. Oct. 2010. Operations Manual, p. 128-129.

Search Report dated Jul. 16, 2014 issued by the European Patent Office in corresponding European Application No. 12001020.2.

* cited by examiner

*Primary Examiner* — Jordan Schwartz

(74) *Attorney, Agent, or Firm* — Sughrue Mion, PLLC

(57) ABSTRACT

An eyeglass lens processing shape obtaining method for attaching a prescription lens having an edge thicker than an original lens and having refractive power to a rim of an eyeglass frame, in place of the original lens attached to the rim, the method includes: obtaining an outline of the original lens; obtaining an inner boundary of the rim on a surface of the original lens in a state where the original lens is attached to the rim; obtaining an external form processing shape of the prescription lens based on the outline of the lens; and obtaining a step processing shape of the prescription lens based on the inner boundary of the rim.

11 Claims, 7 Drawing Sheets

EYEGLASS LENS PROCESSING SHAPE OBTAINING METHOD

BACKGROUND

The present invention relates to an eyeglass lens processing shape obtaining method of obtaining an eyeglass lens processing shape for attaching a prescription lens having refractive power to a rim of an eyeglass frame, in place of an original lens having been fitted to the rim.

Eyeglass frames for sunglasses, eyeglass frames of types in which a user is able to simply exchange lenses of different colors (a lens exchange type, and a lens attachment and detachment type) are appearing on the market (for example, see JP-T-2006-510065(WO2004/059367A2). A rim of the eyeglass frame for the sunglasses is formed with grooves for fitting a part of an edge of an original lens. Recently, in place of the original lens fitted to the rim of the frame, there is a higher demand for replacement with the prescription lens (lens with a refractive power). In the case of the original lens for the sunglasses, the thickness of the original lens is uniform, and the rim is formed with a groove which is larger than the thickness of the original lens. However, in a case of inserting the prescription lens (the refractive power lens) into the groove of the rim, since the width of the peripheral edge portion of the prescription lens is greater than the width (thickness) of the original lens, there is a need to perform the processing so as to insert the peripheral edge portion of the prescription lens into the groove of the rim. In other words, there is a need to process the peripheral edge portion of the prescription lens to form a portion to be inserted into the groove of the rim and a stepped portion which is cut off so as not come into contact with (interfere with) the rim. The processing of forming the step is called a step processing. As an eyeglass lens peripheral edge processing apparatus which promotes the automation of the step processing, a device disclosed in JP-A-2009-131939 (US2009-142993A1) is suggested. The device disclosed in JP-A-2009-131939 includes a peripheral edge processing tool capable of performing the step processing.

SUMMARY

However, in the original lens (a sunglass lens or a demo lens) attached to the eyeglass frame for sunglasses as mentioned above, the step processing is not generally performed. For this reason, in a case of wanting to use the prescription lens, it is difficult to specify a step processing position relative to the prescription lens. Furthermore, a method of specifying the step processing position by measuring the groove of the rim with vernier calipers or the like is considered, but the method is considerably time-consuming, and the measurement result is also easily incorrect. For this reason, in the current state, when processing one lens, the size of the step processing position is slowly changed (notch amount gradually increases), and the processing is performed by trial and error until the lens is inserted into the groove without interfering with the rim, whereby such a processing is considerably time consuming.

An object of the present invention is to provide an eyeglass lens processing shape obtaining method and an eyeglass lens processing shape obtaining apparatus capable of obtaining an eyeglass lens processing shape which includes a step processing shape of an eyeglass lens, in view of the problems of the related art.

The present invention provides the following arrangements:

(1) An eyeglass lens processing shape obtaining method for attaching a prescription lens having an edge thicker than an original lens and having refractive power to a rim of an eyeglass frame, in place of the original lens attached to the rim, the method comprising:

obtaining an outline of the original lens;

obtaining an inner boundary of the rim on a surface of the original lens in a state where the original lens is attached to the rim;

obtaining an external form processing shape of the prescription lens based on the outline of the lens; and obtaining a step processing shape of the prescription lens based on the inner boundary of the rim.

(2) The eyeglass lens processing shape obtaining method according to (1), further comprising:

attaching a mark along the inner boundary of the rim in the state where the original lens is attached to the rim;

detaching the original lens attached with the mark from the rim;

obtaining a lens image by photographing the detached original lens, wherein the outline of the lens is obtained by performing an image processing of the lens image, and wherein, in obtaining the rim boundary, an outer outline of the mark attached to the lens surface is obtained by performing the image processing of the lens image, and the inner boundary of the rim is obtained based on the obtained outer outline of the mark.

(3) The eyeglass lens processing shape obtaining method according to (2), wherein in obtaining the rim boundary, the outer outline of the mark is obtained based on the same lens image when obtaining the outline of the lens.

(4) The eyeglass lens processing shape obtaining method according to (2), wherein in obtaining the lens image, the lens is illuminated in a first photographing condition for obtaining the outline of the original lens detached from the rim to obtain a first lens image; and the lens is illuminated in a second photographing condition adjusted so that brightness of an inside of the lens is higher than that of the first lens image, to obtain a second lens image, in obtaining the lens outline, the outline of the lens is extracted based on the first lens image, and in obtaining the rim boundary, the outer outline of the mark attached to the lens surface is obtained based on the second lens image.

(5) The eyeglass lens processing shape obtaining method according to (2), wherein the mark is ink which lowers light transmittance of the original lens.

(6) The eyeglass lens processing shape obtaining method according to (2), wherein the mark is a material of high ductility having characteristics of lowering the transmittance of the original lens, and the material of high ductility is stuck along the inner boundary of the rim.

(7) The eyeglass lens processing shape obtaining method according to (6), wherein the material of high ductility has adhesiveness.

(8) The eyeglass lens processing shape obtaining method according to (1), wherein in obtaining the lens outline, the original lens is detached from the rim and obtaining a lens image by photographing the detached original lens; and a brightness change of the lens image is detected to obtain the outline of the lens based on the detected brightness change.

(9) The eyeglass lens processing shape obtaining method according to (1), wherein in obtaining the rim boundary, design data of the rim is obtained and the inner boundary of the rim is obtained based on the obtained design data.

(10) The eyeglass lens processing shape obtaining method according to (2), wherein in obtaining the lens outline and obtaining the rim boundary, a lens photographing device is used which is configured to photograph the original lens detached from the rim by a camera and perform an image processing of a photographed lens image, and the lens photographing device includes a photographing unit having an imaging element for photographing the lens image of the original lens, and a control unit which obtains an contour of the original lens and the outer outline of the mark by the image processing based on the lens image, the control unit detecting a position where brightness of the lens image is changed in a predetermined inner region with respect to the outline of the original lens so as to obtain a position of the outer outline of the mark relative to the outline of the original lens.

DESCRIPTION OF EXEMPLARY EMBODIMENTS

Figure 1:
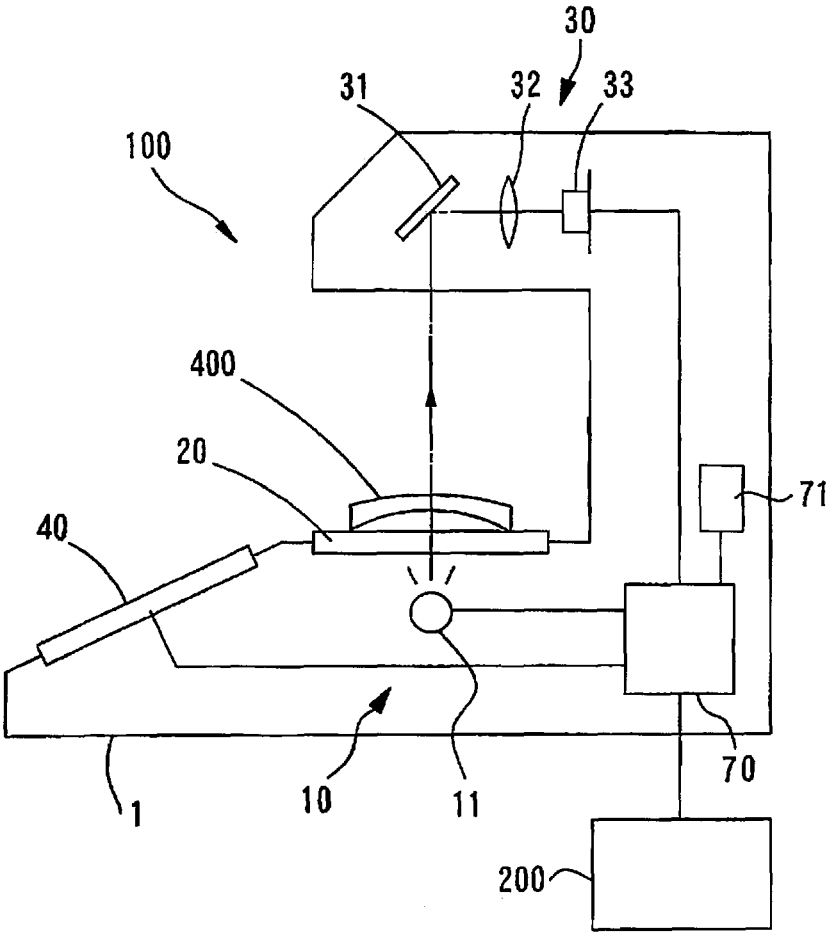
FIG. 1 is a diagram that describes an eyeglass lens processing shape obtaining apparatus.

Hereinafter, an exemplary embodiment of the present invention will be described with reference to the drawings. Firstly, in place of the original lens (the demo lens, sunglasses lens or the like) attached to the rim, the eyeglass lens processing shape obtaining (measuring) apparatus which obtains the processing shape for attaching the prescription lens having refractive power to the rim, and the configuration of the eyeglass lens processing apparatus will be described. FIG. 1 is schematic configuration diagram of an eyeglass lens processing shape obtaining apparatus 100 and an eyeglass lens processing apparatus 200.

An optical unit, described later, and a control unit are housed in a housing 1 of the apparatus 100. An illumination unit 10 is equipped with an illumination light source 11 which emits white light. In a middle space of the housing 1, a lens table 20 is provided on which an original lens 400 fitted to the eyeglass frame is mounted. The lens table 20 is made of a milky-white optically transparent member, and a diffusing surface is formed at the light source 11 side. Thus, the lens 400 is illuminated from below by the diffused light. A photographing unit 30 is placed over the lens table 20, and the photographing unit 30 includes a mirror 31, a lens 32, and an imaging element 33. Light flux transmitted through the original lens is reflected by the mirror 31, is focused on the lens 32, and is imaged on a light sensing surface of the imaging element 33 as the processing shape of the lens image. In front of the lower portion of the housing 1, a monitor 40 is provided which displays a processing shape of the lens 400 and an actual lens image. On the monitor 40, the lens image obtained by the control unit 70 and a target lens shape (an outline processing shape of the lens) obtained by the control unit 70 are displayed in an overlapped manner. Furthermore, the monitor 40 has a touch panel function, and an operation signal of an operator is able to be input to the monitor 40. Although the details thereof will be described later, on the monitor 40, an operator performs an operation such as correction of the processing shape while viewing the lens image. The light source 11, the imaging element 33, and the monitor 40 are connected to the control unit 70 which collectively controls the apparatus 100. The control unit 70 obtains outline information of the lens or the like from a lens image (a captured image) of the lens 400. Furthermore, the control unit 70 corrects the processing shape based on the input from the monitor 40. Additionally, when correcting the processing shape, the control unit 70 is able to perform a smoothing process of a line (a curve) indicating the processing shape. A memory 71, which stores the processing shape of the lens 400 obtained by the imaging process and the identification information of the lens 400, is connected to the control unit 70. Furthermore, in the memory 71, photographing conditions (herein, two types) of the illumination unit 10 and the photographing unit 30 are stored.

Furthermore, the eyeglass lens processing apparatus 200 connected to the apparatus 100 (the control unit 70) includes a chuck shaft which chucks a processing target lens that is a prescription lens, and a processing tool (a coarse processing tool, and a finished processing tool) for grinding a peripheral edge of the chucked processing target lens. Furthermore, the apparatus 200 includes a step processing tool (a step bevel processing tool) for performing a step processing on the peripheral edge of the lens. The step processing tool is also used for correcting (cutting) a curved back surface of the processing target lens or a lens shoulder. In regard to the eyeglass lens processing apparatus 200 and the step processing tool, a technique disclosed in JP-A-2009-131939 is referenced. Furthermore, the apparatus 200 includes a processing grindstone (a front curved grindstone, and a back curved grindstone) for forming the curved on a front and a back of a high curve lens, respectively. With the processing grindstone, a chamfering of the front and the back of the high curve lens as well as the formation of the curved are possible. In regard to the processing grindstone, the technique disclosed in JP-A-2009-131939 is referenced. Furthermore, the apparatus 200 includes a tool for forming a concave portion and a notch in the lens peripheral edge by performing the notching processing on the peripheral edge of the lens. Specifically, the device refers to an end mill that is a drilling tool. In regard to the notching processing, the technique disclosed in JP-A-2009-131939 is referenced.

In addition, the illumination unit 10 of the lens in the present embodiment has a configuration (a transmitting type) in which the illumination light is transmitted through the lens table 20, but is not limited thereto. A reflective type may also be adopted. A configuration may be adopted in which the illumination unit 10 is disposed at the same side (the upper portion) as the photographing unit 30, the reflection member (for example, a recurrent reflection member) is disposed at the lens table 20, and the illumination light is emitted from the upper part. For example, it is possible to use a technique disclosed in JP-A-2010-262034.

Figure 2A:
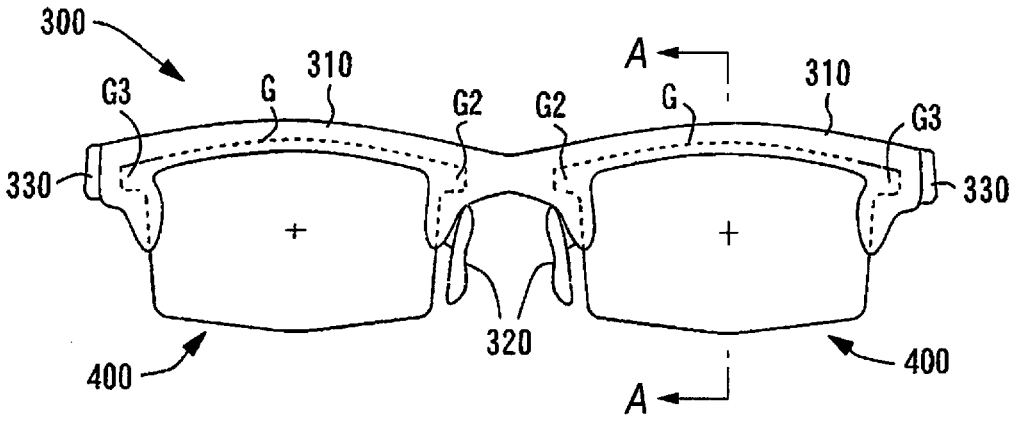
FIGS. 2A-2C show a diagram that describes a configuration of an eyeglass frame and a lens fitted to the rim of the eyeglass frame.
Figure 2B:
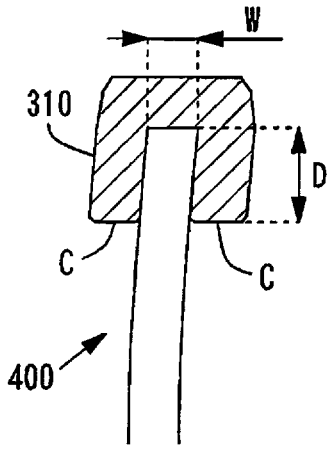
Figure 2C:
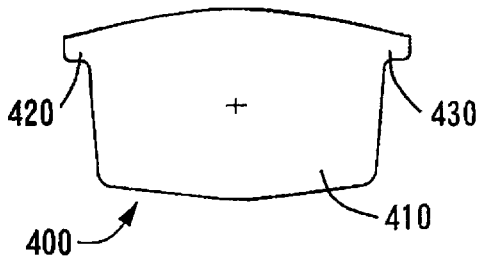

FIGS. 2A to 2C are diagrams that describe a lens exchange type eyeglass frame and a configuration of the original lens used in the eyeglass lens. FIG. 2A is a front view of the eyeglass lens, FIG. 2B is a cross-sectional view taken from a line A-A of FIG. 2A, and FIG. 2C shows a front view (a diagram when viewed from the front) of the original lens 400 for a left eye. In the present embodiment, the eyeglass frame (hereinafter, simply a frame) refers to a lens exchange type frame which enables a user to attach and detach the eyeglass lens. The eyeglass frame 300 generally includes a rim 310 (a lens frame) that holds the original lens 400, a nose pad 320, and a temple 330. In FIG. 2A, the rim 310 is formed with a groove G shown by a dotted line. In the groove G, a concave portion G2 is formed in the nose side upper portion, and a concave portion G3 is formed in the ear side upper portion. The concave portions G2 and G3 have shapes fitted into convex portions of the lens described below. As shown in FIG. 2B, the groove G is formed so as to be notched (recessed) by a height (a depth) D from an edge C of the rim 310. Furthermore, a width (a length in a front and rear direction relative to the frame) W of the groove G is the same as the thickness of the lens 400 so that the backlash is reduced when receiving the lens 400 in the rim 310.

The lens 400 shown in FIG. 2C includes an optical portion 410, a convex portion 420 formed in a nose side upper portion of the optical portion 410, and a convex portion 430 formed in an ear side upper portion of the optical portion 410. The convex portion 420 is fitted to the concave portion G2 and the concave portion 430 is fitted to the concave portion G3, whereby the lens 400 is supported in the groove G and is held in the frame 300 (the rim 310). In addition, the frame 300 is formed of a material such as resin having slight flexibility so as to easily insert the lens 400.

Figure 3A:
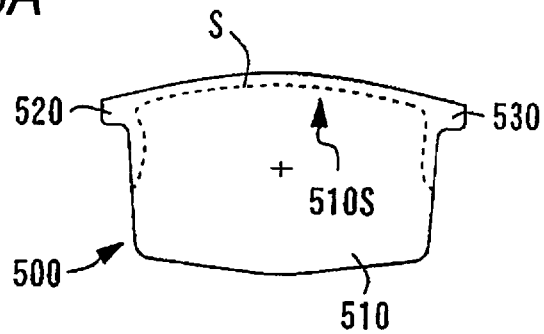
FIGS. 3A-3C show a diagram that describes a configuration of a case of exchanging a lens fitted to the eyeglass frame for the prescription lens.
Figure 3B:
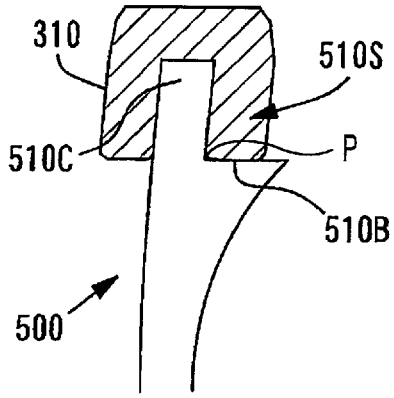
Figure 3C:
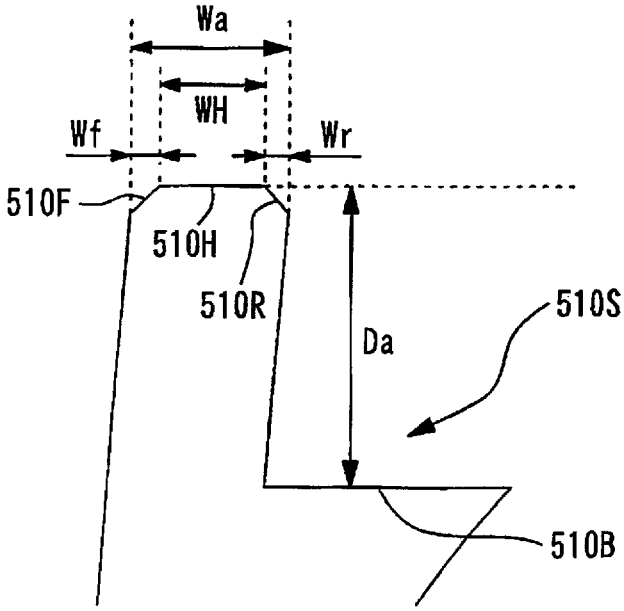

Next, a case of attaching the prescription lens to the rim 310 of the frame 300 will be described. FIG. 3 is a cross-sectional view of a case of attaching the frame 300 to the prescription lens (a lens with the refractive power) 500. Herein, the lens 500 is a concave lens, and has a great thickness at the circumferential portion compared to the thickness of an optical center (an optical axis). FIG. 3A is a front view of the lens 500. FIG. 3B is a cross-sectional view (the same as the A-A cross-section) of the lens 500 held in the rim 310. FIG. 3C is an enlarged schematic diagram of the peripheral edge portion of the lens 500.

Like the case of the lens 400, the processed lens 500 includes an optical portion 510, a convex portion 520, and a convex portion 530. Furthermore, as shown in FIG. 3B, the lens 500 includes an end portion 510C which is received in the groove G when being inserted into the rim 310 and a step portion 5105 which approximately comes into contact with the edge C of the rim 310 that is the back (rear) side of the lens 500. The convex portion 520 and the convex portion 530 are formed by the notching processing through an end mill. The step portion 510S is formed so as to be cut in a step shape by the step processing tool. In FIG. 3A, a boundary portion P (see FIG. 3B) of the step portion 510S is indicated by a dotted line S.

The thickness of the peripheral edge portion (an edge) of the lens 500 is greater than the width W of the original lens 400. For this reason, in a case of fitting the lens 500 in the rim 310, there is a need to perform the step processing so that the lens 500 is inserted into the groove G. Specifically, the processing is performed which makes the thickness of a region (a position) of the lens 500 corresponding to the groove G, the concave portion G2 and the concave portion G3 identical to the width W (or equal to or less than the width). In other words, this processing is a processing which cuts the back side of the lens 500 of the region corresponding to the groove G, the concave portion G2 and the concave portion G3 over a height D.

The peripheral edge surface of the lens 500 will be described (see FIG. 3C). The peripheral edge portion of the lens 500 includes a flat portion 510H finished evenly, a front chamfered portion 510F chamfered, a back chamfered portion 510R chamfered, and a step portion 510S subjected to a step processing at the back side. The step portion 510S has a base portion 510B which is cut in the lens back direction (a direction approximately along the axial direction of the lens 500) and substantially comes into contact with the edge of the rim 310.

The processing is performed such that a width Wa, in which a width Wf of the front chamfered portion 510F, a width Wh of the flat portion 510H, and a width Wr of the back chamfered portion 510R are summed up, matches the width W of the original lens 400. The processing is performed such that a height (a distance from the base portion 510B to the flat portion 510H) Da of the step portion 510S matches the height D of the original lens 400. The base portion 510B is cut backward substantially horizontally such that the optical portion 510 does not interfere with the rim 310.

Although a detailed description is omitted, a lens blank is ground from the peripheral edge by a coarse grindstone and a finishing grindstone of the apparatus 200, and is processed to an external shape a shape before the cutting) of the lens 500. Moreover, the front chamfered portion 510F is processed by the front curved processing grindstone of the apparatus 200, and the back chamfered portion 510R is processed by the back curved processing grindstone. The back side is cut off by the step processing tool so that the width Wa of 510C becomes the width W and the height Da becomes the height D. The peripheral edge of the lens 500 is cut such that the convex portion 520 and the convex portion 530 are formed by the end mill of the apparatus 200. At this time, the dotted line S of FIG. 3A is a step processing position of the lens 500 (a step processing shape).

Figure 4A:
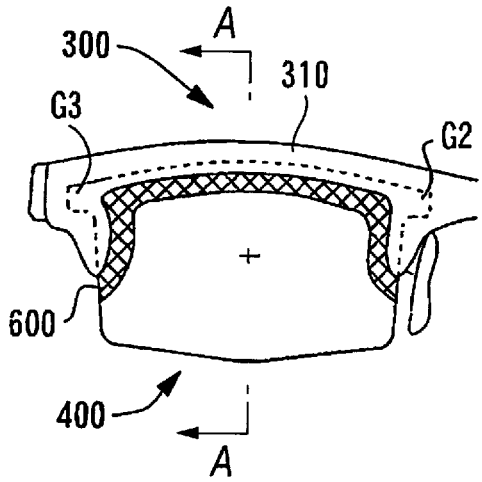
FIGS. 4A-4C show a diagram that describes a method of obtaining the step processing position from the original lens.
Figure 4B:
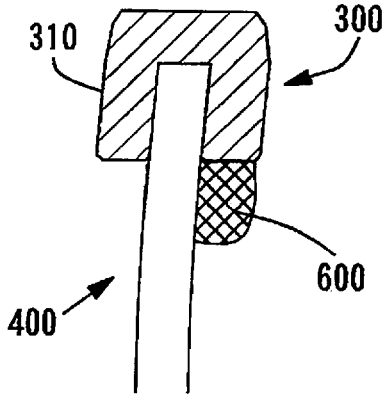
Figure 4C:
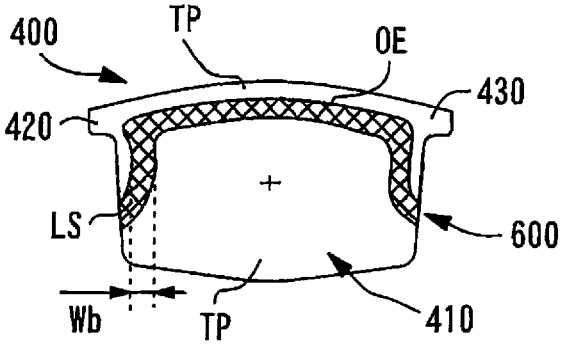

Next, a method of obtaining the processing shape (the target lens shape and the step processing position) of the lens 500 from the original lens 400 will be described. FIGS. 4A to 4C are schematic diagrams that show a method for obtaining the step processing position from the lens 400. FIG. 4A is a diagram that views the lens 400 framed into the frame 300 (the rim 310) of the left eye side from the lens back side. FIG. 4B is a cross-sectional view taken from a line A-A of FIG. 4A. FIG. 4C is a front view (a diagram viewed from the lens front side) of the lens 400 detached from the rim 310.

As shown in FIG. 4A, on the lens surface (herein, on a back of the lens 400) requiring the step processing, a putty-like member (hereinafter, putty) 600 is attached (stuck) as a mark (a mask) along the inner edge (the inner boundary) of the rim 310. The material of the putty 600 has characteristics (a light shielding property) of lowering the transmittivity of the original lens 400, has the ductility and adhesiveness. Preferably, the putty 600 shields the illumination light from the illumination unit 10, and has the light shielding property to such a degree that the position (herein, the outer peripheral edge) of the mark is easily discerned in the image processing in a case of photographing the lens image. Furthermore, the material of the putty 600 has the ductility (plasticity and flexibility) to such a degree that an operator is able to expand (extend) the putty 600 to the optical portion 410 by a finger or the like. Furthermore, in a case of peeling the putty 600 from the lens 400, it is preferable that the material have ductility to an extent that the putty 600 is integrated without being torn and is peeled off. It is preferable that the putty 600 have sufficient adhesiveness to not be peeled off when detaching the lens 400 from the rim 310 while maintaining the state of being stuck to the lens 400. Furthermore, it is preferable that the putty 600 have adhesiveness to an extent that an operator can peel off the putty 600 with their finger or the like. As a result, the putty 600 is easily reused. Furthermore, the frame 300 or the like is difficult to be contaminated. It is preferable that the putty 600 have the sufficient adhesiveness to be capable of being stuck to the lens 400 (does not deviate) even in a case where a water repellent coating is not performed on the lens 400.

In addition, the putty 600 may not necessarily have adhesiveness. By using with an adhesive tape or the like, the putty 600 may be stuck to the lens 400.

The putty 600 of the present embodiment is a member which is obtained by mixing polybutylene, adhesive, and inorganic mineral filler. The putty 600 is a white clay-like member having adhesiveness. Furthermore, the putty may be a member in which a soft rubber having adhesiveness is processed to a cord shape or a plate shape, a viscous liquid (fluid) having adhesiveness and having characteristics of being solidified when being attached to the lens 400, or the like.

The putty 600 is stuck so as to ensure the width Wb from the edge of the rim 310 toward the internal direction of the lens 400 (approximately, the frame center direction). The width Wb is a width used for the image processing when photographing the putty 600 by the apparatus 100 and extracting the step processing position (the outer peripheral edge position of the putty 600).

When detaching the lens 400 from the rim 310, as shown in FIG. 4C, the putty 600 is maintained in the stuck state. In the lens 400, the lens is divided into a transmission region TP of the lens 400 (the optical portion 410, the convex portions 420 and 430) which relatively transmits light, and a light shielding region LS (a diagonal portion) in which light is shielded by the putty 600. In the drawings, an outer peripheral edge OE, which is an outer outline of the putty 600, shows a position of the inner outline of the rim 310. In other words, the outer peripheral edge OE shows an inner edge of the rim 310 on the surface of the original lens. Thus, in the present embodiment, by detecting the outer peripheral edge OE and the outer shape of the lens 400, the processing shape of the eyeglass lens (the prescription lens) can be obtained.

Figure 5A:
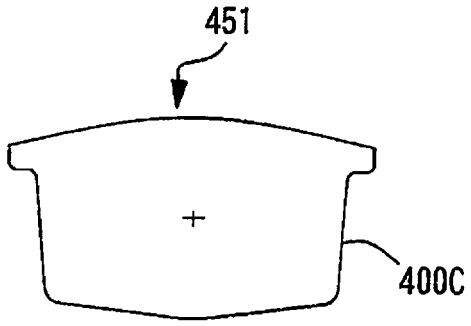
FIGS. 5A-5C show a diagram that describes the lens image photographed by the eyeglass lens processing shape obtaining apparatus.
Figure 5B:
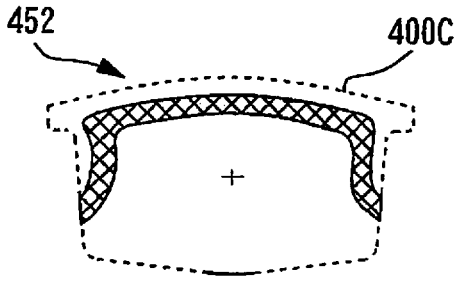
Figure 5C:
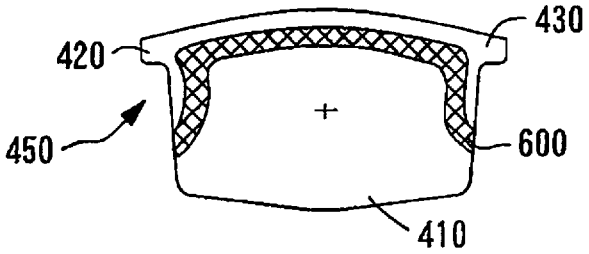
Figure 6:
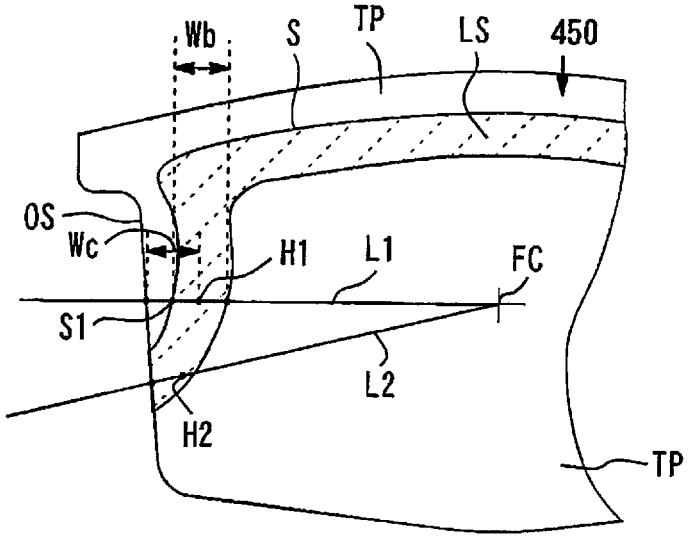
FIG. 6 is a diagram that describes a method of obtaining the step processing position from the lens image.

Next, a method of obtaining the processing shape of the lens by photographing the lens 400 attached with the putty 600 and performing the image processing of the photographed lens image will be described. FIGS. 5A to 5C are diagrams that describe the lens image of the lens 400 obtained by the apparatus 100. FIG. 6 is a diagram that describes a method of detecting the step processing shape from the lens image.

The control unit 70 drives the illumination unit 10, emits the illumination light to the lens 400 placed on the lens table 20, and obtains the lens image by photographing the transmitted light by the photographing unit 30 (the imaging element 33). At this time, two lens images having different photographing conditions are obtained. A change in photographing condition of the present embodiment is performed by making the amount of light of the illumination light source 11 uniform and changing the gain of the imaging element 33. The control unit 70 manages the lens image as a two-dimensional (for example, XY coordinates) brightness distribution.

A first lens image (a first image) 451 shown in FIG. 5A is a photographed image which is illuminated by a first photographing condition for easily extracting the external shape (the outline) 400C of the lens 400 and is photographed. A second lens image (a second image) 452 shown in FIG. 5B is a photographed image which is photographed by a second photographing condition adjusted so that the brightness inside the lens 400 is increased compared to the first lens image. The second photographing condition is set so that the gain of the imaging element 33 is adjusted to be higher than the first photographing condition such that the outline state of the putty 600 as a mark attached to the inside of the lens 400 is easily extracted even when the lens 400 is a sunglass lens in which the transmittivity of visible light is lowered. In this case, in the lens image 452, a wraparound phenomenon of the illumination light is generated in a boundary portion between the lens 400 and the lens table 20, and the outline 400C of the lens 400 becomes a cloudy shape. The contrast is increased with respect to the background, and the outline of the putty 600 is easily detected.

The lens image 450 shown in FIG. 5C is a lens image in which the lens image 451 and the lens image 452 are synthesized by the image processing. Since the lens 400 is placed on the lens table 20, the lens image 451 and the lens image 452 are photographed so that the position is not changed. For this reason, it is possible to superimpose two different lens image 451 and lens image 452 in the same reference position. At this time, the control unit 70 performs the image processing of the lens image 451, and obtains the outline information of the lens 400 to obtain the external shape (the external shape processing shape of the prescription lens). Furthermore, the image processing of the lens image 452 is performed to obtain the putty 600 (the light shielding region LS). The control unit 70 obtains the lens image 450 which includes the outline information of the lens 400, and the outer outline information of the putty 600 that is a mark attached to the surface of the lens 400, by synthesizing them.

Next, the detection of the step processing position will be described. In FIG. 6, a line L1 is drawn from the external shape OS of the lens 450 toward a center position (a geometric center position of the outline of the lens 400 obtained by the image processing) FC of the lens image 450. The control unit 70 detects the brightness change of the pixel on the line L1 from the external shape OS. The control unit 70 confirms the brightness change up to the point H1 on the line L1, and detects the great brightness change, specifically, the position in the coordinate changed from the brightness value of the transmission region TP to the brightness value of the light shielding region LS as the point S1.

Herein, the point H1 is a point for defining the region where the brightness change is detected by the control unit 70, and is set depending on the distance from the external shape OS. The point is set in the external (peripheral edge side) position further than the width Wb of the case of sticking the putty 600. The width We connecting the external shape OS with the point H1 on the line L1 is set to be longer than the width Wb. For example, in order to cope, with even a case where the convex portion is present in the external shape OS (the transmission region is wide), the point H1 is situated in a position entering the inside from the external shape OS by about 6 mm.

Next, unlike the line L1, a case of detecting the brightness change of the pixel on the line L2 passing through the center position FC will be described. The brightness change on the line L2 from the external shape OS is detected up to the point H2. The point H2 is a point set to be identical to the point H1. In the line L2, the control unit 70 is unable to detect the brightness change. At this time, the control unit 70 determines that there is no step processing position.

Herein, the putty 600 is preferably stuck so that the light shielding region LS includes points becoming the standard, such as the points H1 and H2. When the putty 600 is stuck by a width smaller than the width Wb and a plurality of outlines are detected as the outline information of the putty 600 is detected, an operator may delete unnecessary information on the monitor 40.

Figure 7:
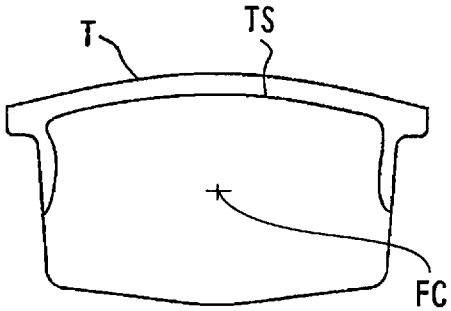
FIG. 7 is a diagram that describes the processing shape of the eyeglass lens.

By obtaining the position (the position of the outer peripheral edge of the light shielding region LS) of the position of the point S1 obtained in this manner in response to the external shape OS, the step processing position S is obtained. The control unit 70 converts the external shape OS and the step processing position S into polar coordinates (a radius r and an angle θ), respectively, based on the center position FC, and obtains the target lens shape T which is the outer processing shape of the original lens, and the step processing position TS which is the step processing shape shown in FIG. 7. At this time, the control unit 70 performs the correction of a processing diameter by the step processing tool of the apparatus 200, and may perform the correction of the shape of the step processing position TS. In addition, information such as the diameter of the processing tool is stored in the memory 71 in advance. In regard to the technique, a technique disclosed in JP-A-2006-95684 is applied. The target lens shape T and the step processing position TS are stored in the memory 71.

Figure 8:
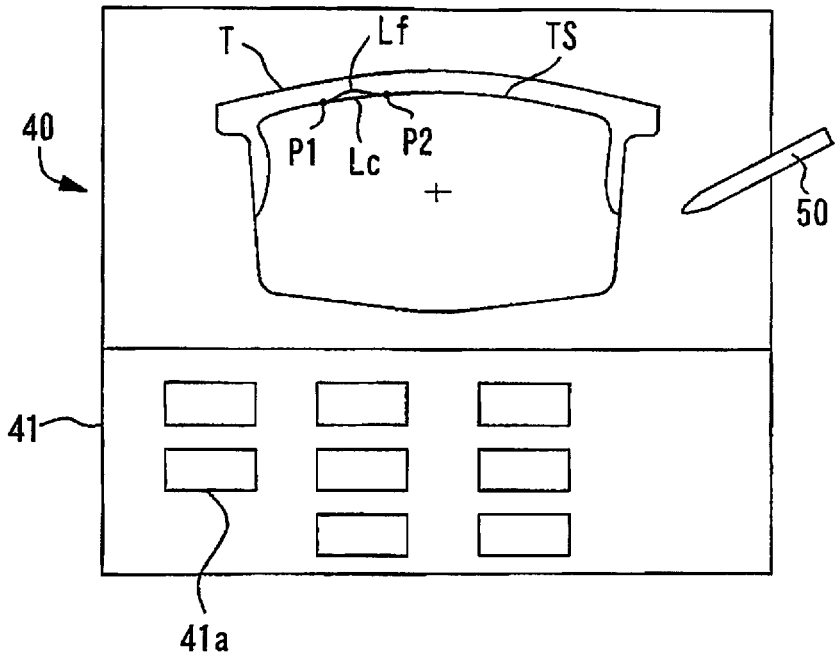
FIG. 8 is a diagram that shows the screen which corrects the step processing position.

Furthermore, the apparatus 100 includes a configuration which corrects the obtained processing shape. The control unit 70, by the signal input from the monitor 40, is called a mode that is able to manually correct the shape of the step processing position TS by an operator. FIG. 8 is a diagram that shows a screen which corrects the step processing position. The lens image 450 is displayed on the monitor 40, and the target lens shape T and the step processing position TS are displayed by graphic lines, respectively. In addition, for convenience of explanation, in FIG. 8, the display of the lens image 450 is omitted. An operator selects the correction mode switch 41*a* of the operation panel 41 displayed on the monitor 40, and corrects the step processing position TS. An operator performs the operation of the switch or the like by the use of the touch pen 50. An operator designates two points (P1 and P2) on the corrected step processing position TS by the touch pen 50. The line Lf interposed between the points P1 and P2 becomes a correctable region. In the present embodiment, a line Lc is indicated which is a curve connecting the point P1 with the point P2 and having a predetermined curvature. The line Lc is able to change the curvature by the drag through the touch pen 50. For this reason, an operator changes the corrected shape while dragging (designating) the line Lc by the touch pen 50. Moreover, by separating the touch pen 50 from the monitor 40, the change in shape of the line Lc is finished. When selecting the switch 41*a* again, the control unit 70 finishes the correction mode and stores the step processing position TS after the correction in the memory 71.

An operation of the apparatus including the configuration as mentioned above and the processing shape obtaining method of the eyeglass lens will be described. An operator sticks the putty (the mark) 600 to the back side of the original lens 400 held in the rim 310. At this time, it is preferable that the putty 600 be thinly stuck. As a result, in the photographing of the lens image, the irregularity of the outline information of the putty 600 is suppressed. Moreover, an operator detaches the lens 400 from the rim 310 and mounts the lens 400 on the lens table 20. At this time, the front of the lens 400 faces upward. An operator operates the apparatus 100 and obtains the processing shape. The control unit 70 obtains the lens image 450 from the lens images 451 and 452 photographed by the first photographing condition and the second photographing condition. The control unit 70 extracts the outline information from the lens image 450 by the image processing, and obtains the processing shape (the target lens shape T and the step processing position TS). An operator compares the lens image 450 (not shown in FIG. 8) to the processing shape of the step processing apparatus TS by the monitor 40. In the case of correcting the processing shape, the switch 41*a* is selected to perform the correction. The processing shape obtained by the control unit 70 is stored in the memory 71. Incidentally, if it is not necessary to change the photographing condition (in the case that the lens has high transmittivity of visible light), the target lens shape T and the processing shape of the step processing position TS can be obtained from one lens image 451 (or the image 452).

In this way, by attaching the mark to the eyeglass lens (the original lens) and obtaining the external shape and the step processing position by the image processing, the processing shape can simply be obtained. Furthermore, by using the putty 600 as the mark, the frame, the lens or the like are not contaminated. Furthermore, reusability of the putty 600 is high, which can suppress the cost.

The processing shape of the lens stored in the memory 71 is transmitted to the apparatus 200. (The control unit of) The apparatus 200 calculates the processing data (a coarse processing trace, cutting processing data or the like) from the processing shape, and processes the processing target lens (the prescription lens 500) using the respective processing tools. The processed lens can be fitted into the rim of the frame 300, and simply can be exchanged for the prescription lens by a user.

In addition, in the description mentioned above, the photographing condition of the lens image by the apparatus 100 has a configuration which changes the gain of the imaging element 33, but the present invention is not limited thereto. The photographing conditions such as the outline information for being extracted from the lens image may differ. For example, a configuration may be adopted in which the gain of the photographing element 33 may be constant, and the light emitting amount of light of the illumination light source 11 is changed to change the photographing condition. Furthermore, a configuration has been adopted in which the photographing of the lens image by the apparatus 100 is performed for several times, but the present invention is not limited thereto. If there is a condition in that the external shape of the lens is easily extracted and the outline state of the mark inside the lens is easily extracted, the lens image may be one.

Furthermore, in the description mentioned above, a configuration has been adopted in which the target lens shape obtained from the lens image and the step processing position are corrected, but the configuration is not necessarily required.

Furthermore, in the description mentioned above, a configuration has been adopted in which the clay-like member is used as the mark, but the present invention is not limited thereto. If a configuration is adopted which lowers the light transmittance of the original lens (or shielding the light), a configuration may be adopted in which ink having characteristics (the light shielding characteristics) of lowering the light transmittance is added by a pen. Furthermore, a configuration may be adopted in which the seal having the characteristics of lowering the light transmittance is stuck.

The method of obtaining the exterior processing shape and the step processing shape of the prescription lens is not limited to the usage of the eyeglass lens processing shape obtaining apparatus provided with the illumination unit 10 and the photographing unit 30 of FIG. 1. For example, the eyeglass lens processing shape obtaining apparatus 100 may be designed to obtain design data of the rim 310 of the frame 300 and obtain the inner boundary of the rim based on the obtained design data. The design data of the rim 310 can be obtained from a manufacturing make of the frame 300. Radius vector data of the groove G of the rim 310 and the data of depth D of FIG. 2B with respect to the radius vector data can be obtained based on the design data of the rim 310. If the data of the depth D can be obtained, data of the step processing position TS (for example, polar coordinate data with respect to a geometric center position FC of the target lens shape) can be obtained based on the data of the depth D. The target lens shape T can be also obtained by obtaining design data of the original lens 400 fitted in the rim 310. For example, the design data of the lens 400 can be used as the target lens shape T without any change.

Indeed, the novel methods described herein may be embodied in a variety of other forms; furthermore, various omissions, substitutions and changes in the form of the methods described herein may be made without departing from the spirit of the inventions. The accompanying claims and their equivalents are intended to cover such forms or modifications as would fall within the scope and spirit of the inventions.

What is claimed is:

1. An eyeglass lens processing shape obtaining method for attaching a prescription lens having an edge thicker than an original lens and having refractive power to a rim of an eyeglass frame, in place of the original lens attached to the rim, the method comprising:

obtaining an outline of the original lens;

obtaining an inner boundary of the rim on a surface of the original lens in a state where the original lens is attached to the rim;

obtaining an external form processing shape of the prescription lens based on the outline of the lens;

obtaining a step processing shape of the prescription lens based on the inner boundary of the rim; and processing the prescription lens initially having the edge thicker than the original lens based on the obtained step processing shape for attachment to said rim.

2. An eyeglass lens processing shape obtaining method for attaching a prescription lens having an edge thicker than an original lens and having refractive power to a rim of an eyeglass frame, in place of the original lens attached to the rim, the method comprising:

attaching a mark along the inner boundary of the rim onto a surface of the original lens in the state where the original lens is attached to the rim;

detaching the original lens attached with the mark from the rim;

obtaining a lens image by photographing the detached original lens;

obtaining an outline of the original lens by performing an image processing on the lens image;

obtaining an outline of the mark attached onto the surface of the original lens by performing an image processing of the lens image, and obtaining an inner boundary of the rim on the surface of the original lens based on the obtained outline of the mark;

obtaining a step processing shape of the prescription lens based on the inner boundary of the rim; and processing the prescription lens initially having the edge thicker than the original lens based on the obtained step processing shape for attachment to said rim.

3. The eyeglass lens processing shape obtaining method according to claim 2, wherein in obtaining the rim boundary, the outer outline of the mark is obtained based on the same lens image when obtaining the outline of the lens.

4. The eyeglass lens processing shape obtaining method according to claim 2, wherein in obtaining the lens image, the lens is illuminated in a first photographing condition for obtaining the outline of the original lens detached from the rim to obtain a first lens image; and the lens is illuminated in a second photographing condition adjusted so that brightness of an inside of the lens is higher than that of the first lens image, to obtain a second lens image, in obtaining the lens outline, the outline of the lens is extracted based on the first lens image, and in obtaining the rim boundary, the outer outline of the mark attached to the lens surface is obtained based on the second lens image.

5. The eyeglass lens processing shape obtaining method according to claim 2, wherein the mark is ink which lowers light transmittance of the original lens.

6. The eyeglass lens processing shape obtaining method according to claim 2, wherein the mark is a material of high ductility having characteristics of lowering light transmittance of the original lens, and the material of high ductility is stuck along the inner boundary of the rim onto a surface of the original lens.

7. The eyeglass lens processing shape obtaining method according to claim 6, wherein the material of high ductility has adhesiveness.

8. The eyeglass lens processing shape obtaining method according to claim 1, wherein in obtaining the lens outline, the original lens is detached from the rim and obtaining a lens image by photographing the detached original lens; and a brightness change of the lens image is detected to obtain the outline of the lens based on the detected brightness change.

9. The eyeglass lens processing shape obtaining method according to claim 1, wherein in obtaining the rim boundary, design data of the rim is obtained and the inner boundary of the rim is obtained based on the obtained design data.

10. The eyeglass lens processing shape obtaining method according to claim 2, wherein in obtaining the lens outline and obtaining the rim boundary, a lens photographing device is used which is configured to photograph the original lens detached from the rim by a camera and perform an image processing of a photographed lens image, and the lens photographing device includes a photographing unit having an imaging element for photographing the lens image of the original lens, and a control unit which obtains a contour of the original lens and the outer outline of the mark by the image processing based on the lens image, the control unit detecting a position where brightness of the lens image is changed in a predetermined inner region with respect to the outline of the original lens so as to obtain a position of the outer outline of the mark relative to the outline of the original lens.

11. An eyeglass lens processing shape obtaining method for attaching a prescription lens having an edge thicker than an original lens and having refractive power to a rim of an eyeglass frame, in place of the original lens attached to the rim, the method comprising:

attaching a mark along the inner boundary of the rim onto a surface of the original lens in the state where the original lens is attached to the rim;

detaching the original lens attached with the mark from the rim;

obtaining a lens image by photographing the detached original lens; and processing the prescription lens initially having the edge thicker than the original lens based on a rim boundary for attachment to said rim, wherein the outline of the lens is obtained by performing an image processing of the lens image, and wherein, in obtaining the rim boundary, an outer outline of the mark attached to the lens surface is obtained by performing the image processing of the lens image, and the inner boundary of the rim is obtained based on the obtained outer outline of the mark.

* * * * *